United States Patent [19]

Hsu

[11] Patent Number: 4,621,672

[45] Date of Patent: Nov. 11, 1986

[54] MECHANISM FOR WINDOW BLIND

[76] Inventor: Pei-Shun Hsu, No. 373, Sec. 4, Yen Hai Road, Fu-Nan Tsun, Fu-Hsin Hsian, Chang-Hua Hsieng, Taiwan

[21] Appl. No.: 693,215

[22] Filed: Jan. 18, 1985

[51] Int. Cl.[4] ..... E06B 9/26

[52] U.S. Cl. ..... 160/115; 160/176 R

[58] Field of Search ..... 160/115, 166 R, 174, 160/176 R, 176 B, 177

[56] References Cited

U.S. PATENT DOCUMENTS

| | | | |
|---|---|---|---|
| 2,792,880 | 5/1957 | Moyer | 160/115 |
| 2,794,499 | 6/1957 | White | 160/115 |
| 2,836,237 | 5/1958 | Hogin et al. | 160/115 |
| 3,111,164 | 11/1963 | Lombard | 160/115 |
| 3,921,695 | 11/1975 | Debs | 160/176 R |
| 4,122,885 | 10/1978 | Mavotto | 160/176 R |
| 4,541,468 | 9/1985 | Anderson | 160/177 |

*Primary Examiner*—Robert W. Gibson, Jr.
*Attorney, Agent, or Firm*—Browdy and Neimark

[57] ABSTRACT

A window blind which includes a plurality of horizontal slats and a regulating mechanism that can set the slats at different inclinations so that, when upper slats are opened, lower slats can be closed and vice versa.

3 Claims, 8 Drawing Figures

MECHANISM FOR WINDOW BLIND

BACKGROUND OF THE INVENTION

This invention relates to a window blind, particularly to a window blind having a mechanism that can regulate an upper group of slats and a lower group of slats separately. This invention attempts to make improvements on the conventional window blind of the type having horizontal slats all of which can only be set at the same inclinations.

SUMMARY OF THE INVENTION

An object of the invention is to provide a window blind which includes a regulating mechanism to set horizontal slats at different inclinations so that, when the upper slats are closed to prevent the sunlight, the lower slats can be opened for ventilation and vice versa.

This and other objects can be achieved in accordance with the invention through the provision of a window blind having a shade constituted of a plurality of horizontal slats suspended from a long-shaped support and a mechanism for regulating the slats, wherein the mechanism comprises at least one first roller and at least one second roller mounted for rotation about two parallel horizontal axes in the support, means for driving the first and second rollers separately, at least one first regulating string attached to the first roller and extending downward on front and rear sides of the shade and having first cross-pieces attached thereto at regular intervals for regulating some of the slats, and at least one second regulating string attached to the second roller and extending downward on front and rear sides of the shade and having second cross-pieces attached thereto at regular intervals for regulating the remaining slats, the slats regulated by the first cross-pieces being placed above the slats regulated by the second cross-pieces.

The presently exemplary preferred embodiment will be described in detail with reference to the accompanying drawings, in which:

DETAILED DESCRIPTION OF THE PREFERRED EMBODIMENT

Figures 1, 2:
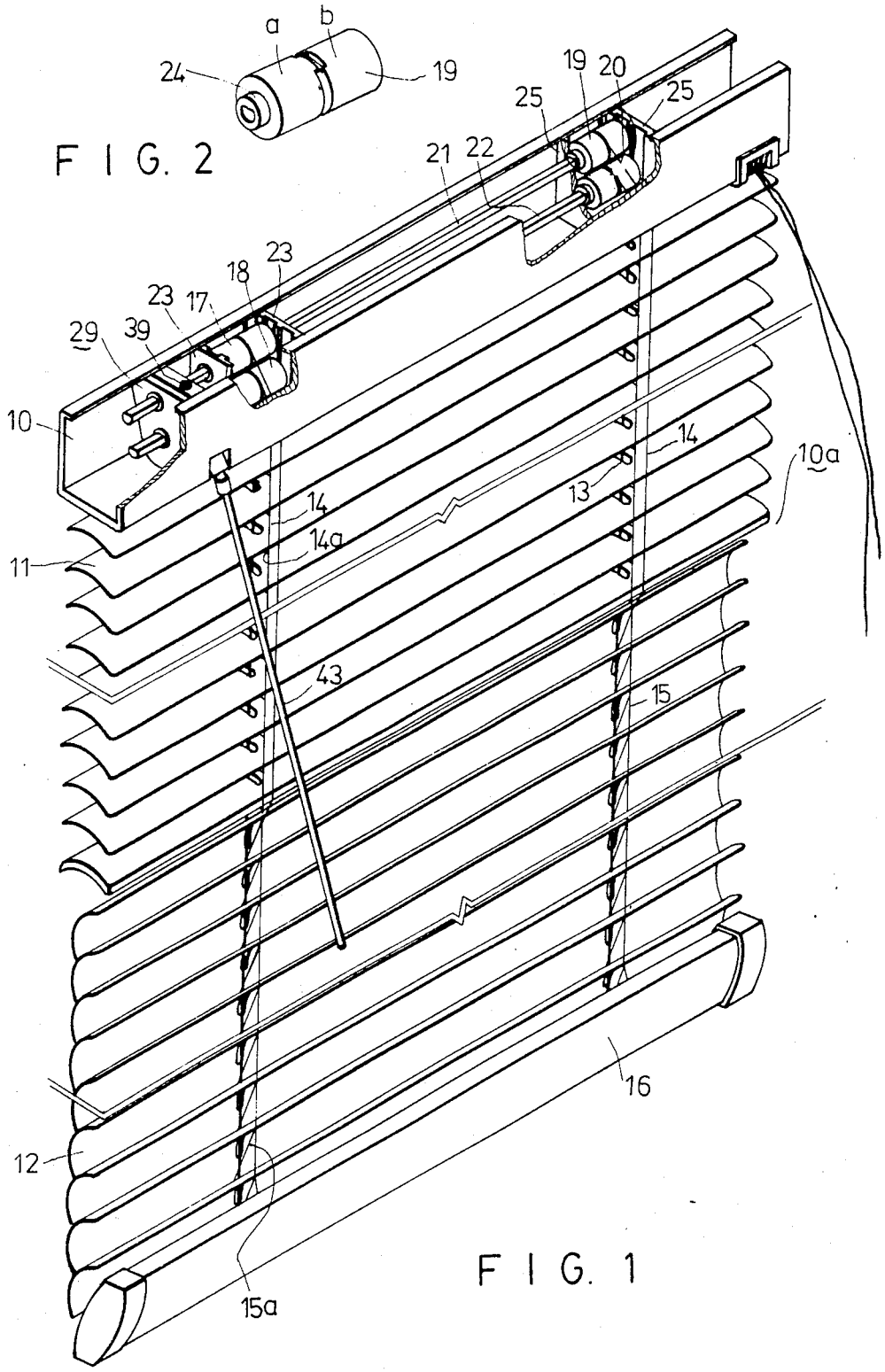
FIG. 1 is a perspective view of a window blind embodying the present invention.
FIG. 2 is an enlarged view of a roller.

Referring to FIG. 1, there is shown a window blind which includes a long-shaped support 10 from which is suspended a shade 10*a* made of a set of horizontal slats 11 and a set of horizontal slats 12 by means of threading strings 13 and regulating strings 14 and 15, all the slats 11 being placed above the slats 12. At the bottom of the slats 12 is provided a bottom bar 16. The support 10 has a U-shaped cross-section and receives a mechanism for regulating the slats 11 and 12 to set them at certain inclined angles.

The mechanism includes four rollers 17, 18, 19 and 20 and two shafts 21 and 22 of semicircular cross-sections for mounting the rollers 17, 18, 19 and 20. As shown in FIG. 2, each of the rollers has a hub 24 which is provided with a bore of semicircular cross-section for being sleeved onto the shafts 21 and 22, and is constituted of two clamping tubular parts a and b which can be separated for insertion of a regulating string 14 or 15. The two ends of the hubs 24 of rollers 17 and 18 are journalled into seat plates 23 and the ends of the hubs 24 of rollers 19 and 20 are journalled in two seat plates 25. The shafts 21 and 22 are inserted in two aligned hubs 24 of the rollers 17, 19 and in two aligned hubs 24 of the rollers 18 and 20 respectively.

Two strings 14 are respectively attached to the rollers 17 and 19 by being clamped between their separable tubular parts which are better shown in FIG. 2, and are extended downward on the rear side and the front side of the shade 10*a*, passing through apertures (not shown) provided in the bottom side of the support 10. The strings 14 are further provided with cross-pieces 14*a* attached thereto at regular intervals for holding slats 11.

Two strings 15 are respectively attached to the rollers 18 and 20 by being clamped between their separable tubular parts which are better shown in FIG. 2 and are extended downward on the rear side and the front side of the shade 10*a*, passing through apertures (not shown) provided in the bottom side of the support 10. The strings 15 are further provided with cross-pieces 15*a* attached thereto at regular intervals for holding slats 12. All the cross-pieces 15*a* are placed below the cross-pieces 14*a*.

Figure 3:
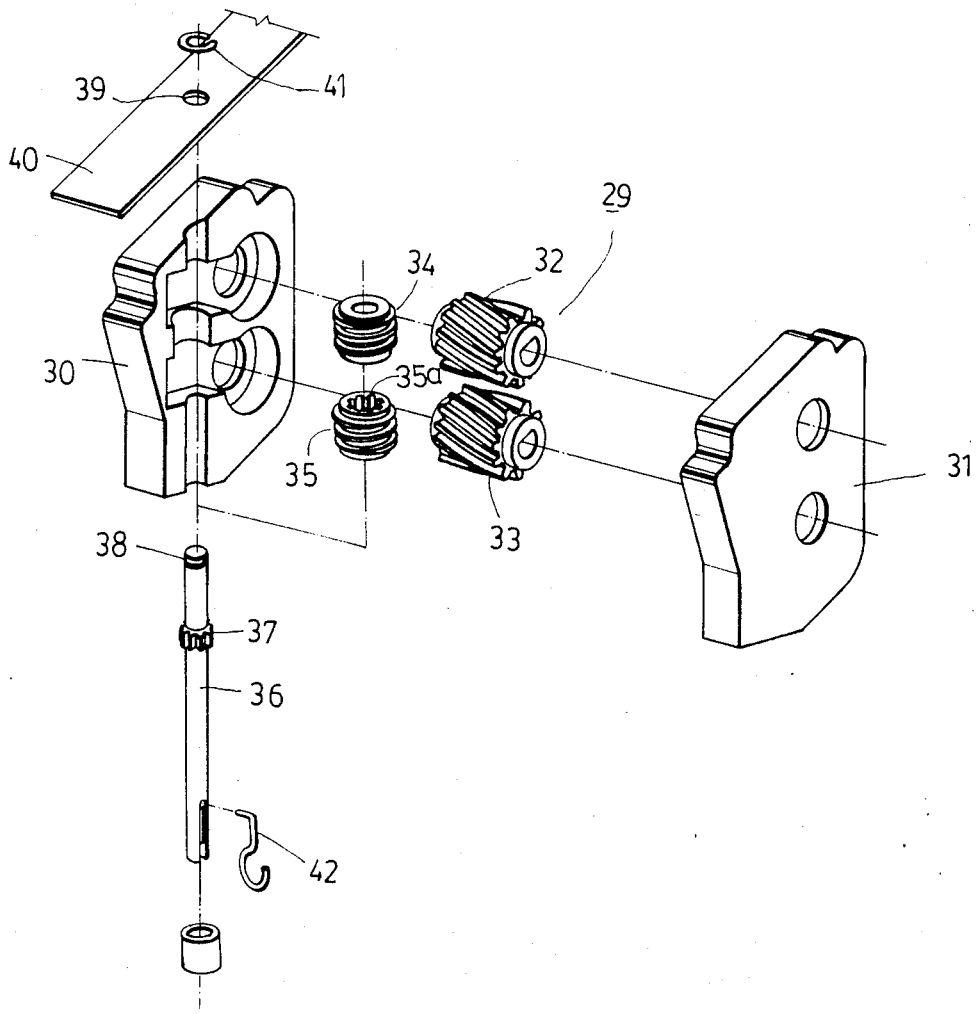
FIG. 3 is an exploded view showing a means for driving the rollers.
Figure 5:
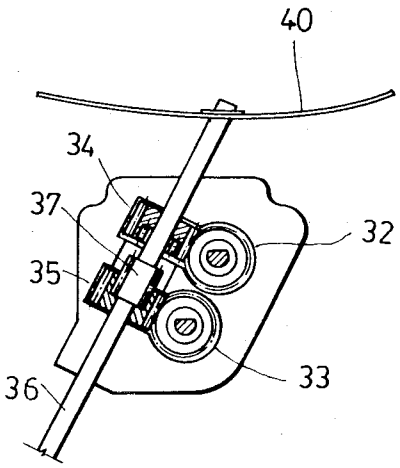
FIG. 5 is a fragmentary sectioned view showing that the lower worm is rotated by the stem.
Figure 4:
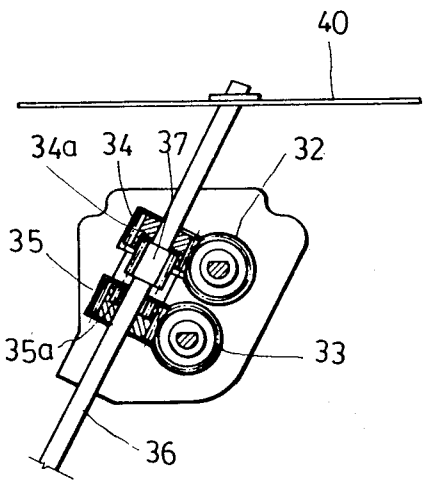
FIG. 4 is a fragmentary sectioned view showing that the upper worm is rotated by the stem.

There is further provided a means 29 for driving the shafts 21 and 22 separately which is shown in FIGS. 3, 4 and 5. The means 29 includes a casing constituted of a member 30 and a member 31 which house two worm wheels 32 and 33 respectively mounted on shafts 21 and 22 and two worms 34 and 35 to mesh with the worm wheels 32 and 33 respectively. A stem 36 having a gear 37 is movably inserted in the worms 34 and 35 and the gear 37 is adapted to mesh with internal gear 34*a* of the worm 34 or 35*a* of the worm 35. The top end of the stem 36 is provided with an annular groove 38 and is extended through aperture 39 of a spring plate 40 which has its two ends fixed to the U-shaped support 10 as better shown in FIG. 1. A retaining plate 41 of a segmented annulus shape is provided at the top side of the spring plate 40 and is engaged in the annular groove 38 of the stem 36. The bottom part of the stem 36 is provided with a hook 42 which connects the stem 36 to a hand operated lever 43.

As shown in FIG. 4, the stem 36 is normally engaged with the internal gear 34*a* of the worm 34 due to the spring plate 40. If the lever 43 is rotated, the worm 34 will transmit the rotational movement to the worm wheel 32, shaft 21 and then rollers 17 and 19. The movements of the rollers 17 and 19 cause cross-pieces 14*a* of the strings 14 to move so as to regulate the inclination of the slats 11.

Figure 7:
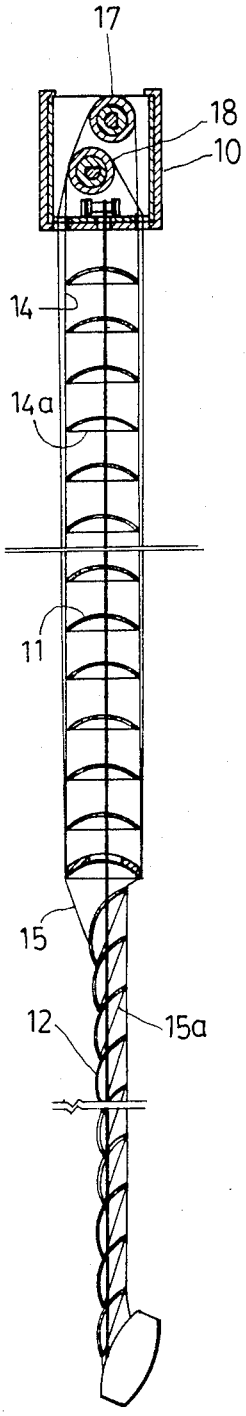
FIG. 7 is a sectioned view of the window blind showing that the lower slats are closed.
Figure 6:
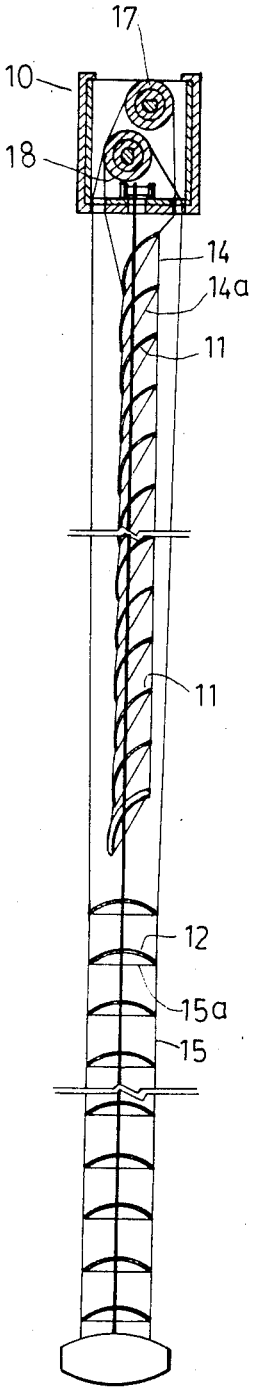
FIG. 6 is a sectioned view of the window blind showing that the upper slats are closed.

As shown in FIG. 5, when the stem 36 is pulled slightly downward, the spring plate 40 is deflected and the gear 37 is made to engage with the internal gear 35*a* of the gear 35. At this time one can regulate the inclination of the slats 12 by operating the stem 36. It can be appreciated that the slats 11 can be closed when the slats 12 are opened as shown in FIG. 6, and the slats 11 can be opened while the slats 12 are closed, as shown in FIG. 7.

Figure 8:
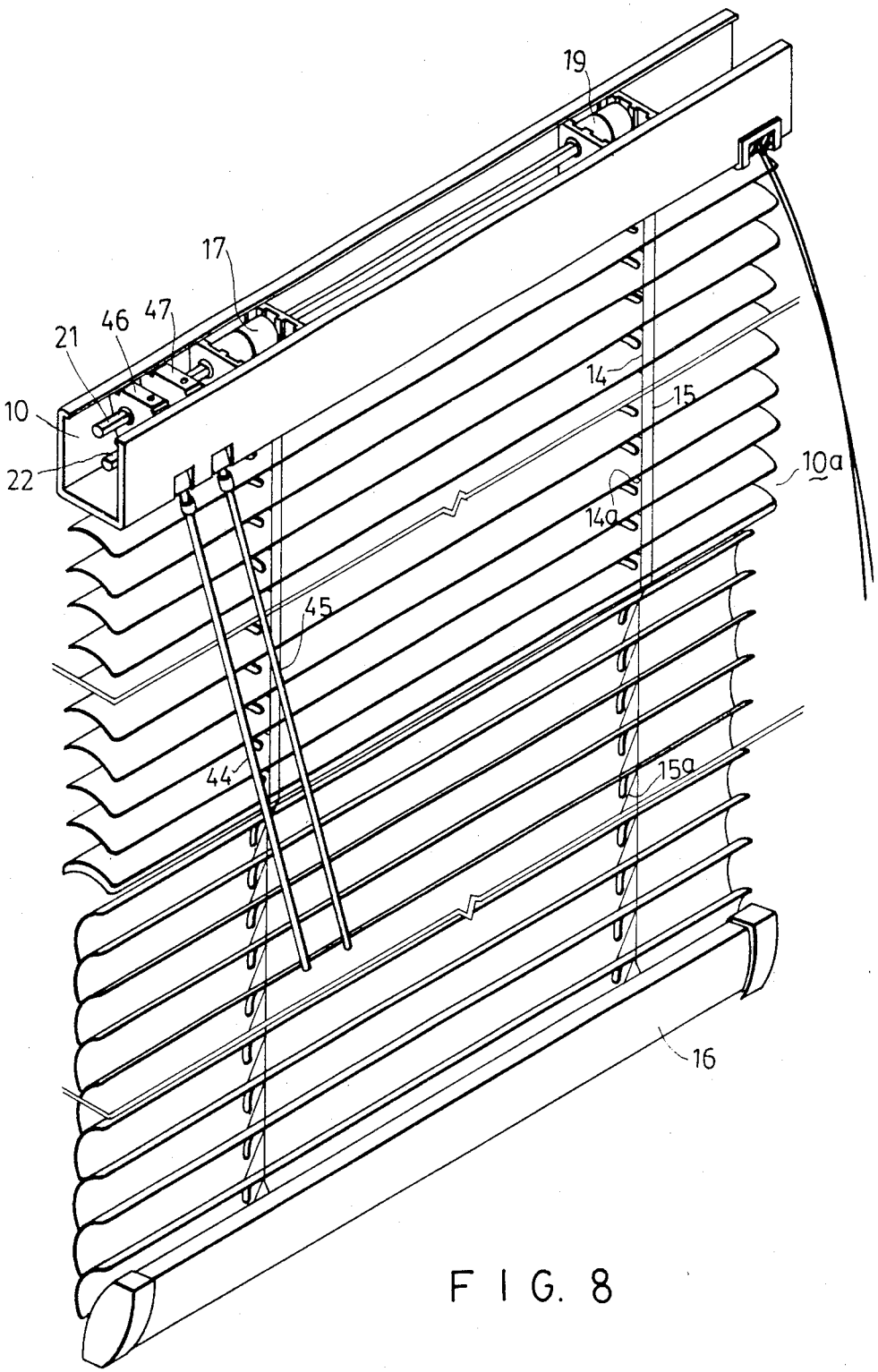
FIG. 8 is a perspective view of another embodiment of the window blind having two hand operated levers.

Another embodiment of the invention is shown in FIG. 8 in which elements which are the same as those of the previous embodiment are represented by the same reference numerals as the previous embodiment. It is provided with two hand operated levers 44 and 45 respectively connected to two stems (not shown) which in turn are fixedly inserted into two worms 34 and 35 respectively. The worm 34 and the worm wheel 32 are encased by a housing 46 and the worm 35 and the worm wheel 33 are encased by a housing 47.

With the invention thus explained, it is apparent that various variations and modifications can be made without departing from the scope of the invention. It is therefore intended that the invention be limited as indicated in the appended claims.

What I claim is:

1. A window blind having a shade constituted of a plurality horizontal slats suspended from a long-shaped support and a mechanism for regulating the slats, wherein the mechanism comprises:

at least one first roller and at least one second roller mounted for rotation about two parallel horizontal axes in the support;

means for driving said first and second rollers separately, said driving means including two worm wheels coaxially mounted with said first and second rollers, respectively, two worms which are respectively put into mesh with said worm wheels, and a single means for operating both said worms;

at least one first regulating string attached to said first roller and extending downward on front and rear sides of said shade and having first cross-pieces attached thereto at regular intervals for regulating some of said slats;

and at least one second regulating string attached to said second roller and extending downward on front and rear sides of said shade and having second cross-pieces attached thereto at regular intervals for regulating the remaining slats;

said slats regulated by said first cross-pieces being placed above said slats regulated by said second cross-pieces.

2. A window blind as set forth in claim 1, wherein said single operating means is supported for sliding movement between a first position in which said operating means causes one of said worms to rotate said first roller, and a second position in which said operating means causes the other of said worms to rotate said second roller.

3. A window blind as set forth in claim 2, wherein said worms are coaxially aligned with one another, and each worm carries internal gear means, and said operating means comprises an elongated rod bearing external means configured for engagement with either one of the internal gear means carried by said worms, whereby when said operating means slides to said first position, said external gear means engages the internal gear means of said one of said worms and when said operating means slides to said second position, said external gear means engages the internal gear means of said other of said worms.

* * * * *